United States Patent [19]

Lee

[11] Patent Number: 4,802,870

[45] Date of Patent: Feb. 7, 1989

[54] UNIVERSAL ELECTRICAL CONNECTOR

[76] Inventor: Noel Lee, 47 W. Park Dr., Daly City, Calif. 94015

[21] Appl. No.: 110,127

[22] Filed: Oct. 19, 1987

[51] Int. Cl.[4] ..... H01R 11/00

[52] U.S. Cl. ..... 439/860

[58] Field of Search ..... 439/883-891, 439/860, 845, 849, 850

[56] References Cited

U.S. PATENT DOCUMENTS

| | | | |
|---|---|---|---|
| 422,058 | 2/1890 | McIntire | 439/881 |
| 582,462 | 5/1897 | Dickerson | 439/221 |
| 783,061 | 2/1905 | Mills | 439/860 |
| 2,264,040 | 7/1939 | Johnson et al. | 439/223 |
| 2,511,806 | 11/1946 | Macy | 439/877 |
| 2,974,302 | 3/1961 | Ellis | 439/889 |
| 3,221,294 | 5/1963 | Roberts | 439/877 |
| 4,738,640 | 4/1988 | Lee | 439/884 |

*Primary Examiner*—John D. Lee
*Assistant Examiner*—John Ngo
*Attorney, Agent, or Firm*—Warren B. Kice

[57] ABSTRACT

An electrical connector for connecting an electrical conductor to an electrical terminal in which two legs extend from a conductor-engaging sleeve in a spaced parallel relation and at an angle to the axis of the sleeve. An extension is formed on one of the legs and extends at angle to the latter leg. The longitudinal axis of the extension coincides with an extension of the axis of the sleeve.

5 Claims, 1 Drawing Sheet

UNIVERSAL ELECTRICAL CONNECTOR

BACKGROUND OF THE INVENTION

This invention relates to an electrical connector, and more particularly, to an electrical connector for making electrical connections between a conductor attached to the connector and one of several different types of electrical terminals.

Spade lugs are often connected to an electrical conductor in order to facilitate a connection between the conductor and a barrier strip, a terminal block, a screw strip or a single terminal all of which utilize a bolt-like member having a threaded shank, or post and a head portion that extends over the spade lug to secure same when the member is tightened. Although the terminals on most electrical components use these types of members, for which a spade lug is ideally suited, other types of terminals are becoming more popular. For example, the terminals on many electronic components use a spring-loaded member, such as a clip, clasp, or button which, when pushed, exposes an opening for receiving an electrical conductor, or a pin attached to an electrical conductor. Upon release, the spring-loaded member engages the conductor or pin to establish an electrical connection between the conductor and the terminal.

Thus, when an electrical component having a barrier strip, a terminal block, or a screw strip having a bolt-like member is replaced by a component having a terminal that does not receive a spade lug, all spade lugs utilized to connect conductors to the old component have to be removed or replaced, which is expensive and time consuming. Conversely, when an electrical component having the aforementioned spring-loaded member is replaced by a component having a barrier strip, or the like, any pin connectors used in connection with the former would be useless with the latter.

U.S. Pat. No. 582,462 discloses an electrical circuit terminal which attempts to solve this problem by providing a spade lug-type connector having two parallel legs extending integrally with a crimping sleeve, and an extension formed on one leg. Thus, a threaded post of a barrier strip would extend between the legs of the spade lug and the extension could extend in openings formed in other types of terminals. However, the arrangement is such that the two parallel legs of the spade lug extend parallel to an extension of the longitudinal axis of the crimping sleeve and are spaced equidistantly therefrom. Thus, when the extension on the one leg is inserted in an opening in an electrical terminal, a moment arm is created between the longitudinal axis of the extension and the extended axis of the crimping sleeve. Therefore, the weight of the conductor acting at the end of this moment arm creates a moment of inertia which tends to pull the extension out from the opening in the terminal and thus compromise the connection.

SUMMARY OF THE INVENTION

It is therefore an object of the present invention to provide an electrical connector which can be utilized as a spade lug in connection with a barrier strip, a terminal block or a terminal having a bolt-like member, and, in addition, can be used as a pin-type connector in connection with a spring-loaded member, or other similar terminal having an opening for receiving a conductor or a pin type connector.

It is a further object of the present invention to provide an electrical connector of the above type which can be connected to any of the above type terminals without introducing any moments of inertia.

Toward the fulfillment of these and other objects, the electrical connector of the present invention comprises a pair of spaced parallel legs extending from a base member which is preferably in the form of a sleeve. The legs extend at an angle to the axis of the sleeve and an extension is formed on one of the legs and extends at an angle thereto, with the longitudinal axis of the extension coinciding with an extension of the axis of the sleeve.

BRIEF DESCRIPTION OF THE DRAWINGS

The above brief description as well as further objects, features and advantages of the present invention will be more fully appreciated by reference to the following detailed description of presently preferred but nonetheless illustrative embodiments in accordance with the present invention when taken in conjunction with the accompanying drawings wherein.

DESCRIPTION OF THE PREFERRED EMBODIMENT

Figure 1:
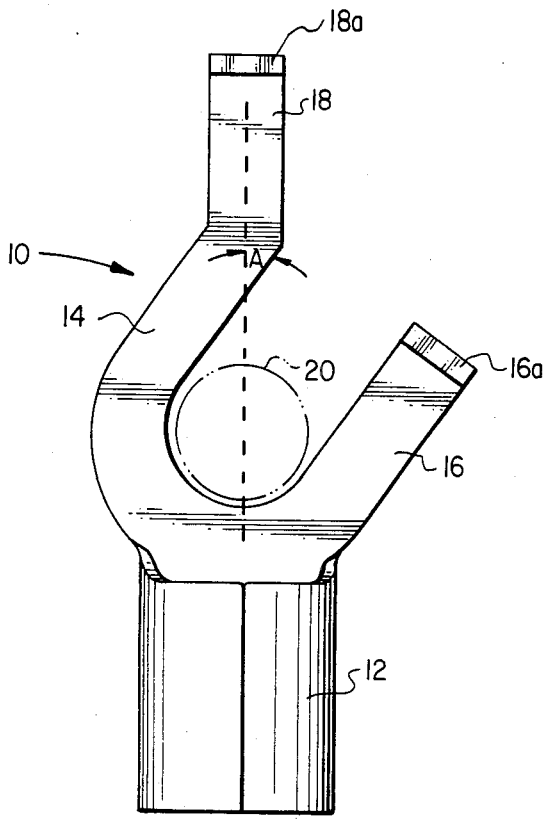
FIG. 1 is a front elevational view of the spade lug of the present invention.

Referring to the drawings, the reference numeral 10 refers, in general, to the universal connector of the present invention. The connector 10 is formed by a strip, or plate, either fabricated of, or plated with, an electrical current conducting material, such as copper, brass, or gold, and is stamped, or otherwise cut, into the configuration shown.

The lower portion of the connector 10 includes a base portion which is formed into a cylindrical crimping barrel, or sleeve, 12 by bending the lower opposite edge portions of the strip inwardly until they abutt. The upper portion of the strip is cut into a generally U-shaped pattern, with the legs 14 and 16 of the U extending at an angle A to an extension of, or a line passing through, the longitudinal axis of the sleeve 12, which line is shown by the dashes in FIG. 1.

The upper end portion of the leg 14 has an extension 18 formed integrally therewith which coincides with the aforementioned line passing through the longitudinal axis of the sleeve 12. Thus, the center line, or longitudinal axis, of the extension 18 is disposed at the angle A to the center line, or longitudinal axis, of the leg 14.

Figure 2:
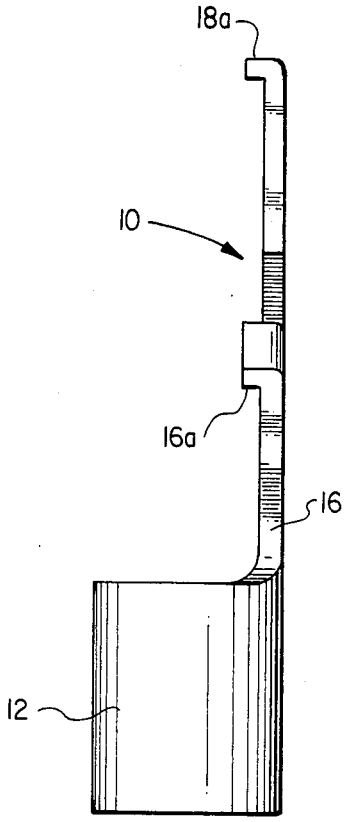
FIG. 2 is a side elevational view of the spade lug of FIG. 1.

The ends 16*a* and 18*a* of the leg 16 and the extension 18, respectively, are bent forward, or towards the sleeve 12, as shown in FIG. 2 to extend perpendicular to the remaining portions of the leg and extension, respectively, for reasons that will be explained.

Prior to use, a conductor (not shown) is stripped of insulation at its end portion and the latter placed in the sleeve 12. The sleeve 12 is then crimped over the stripped conductor portion by a pair of pliers, or the like, to secure the conductor in the sleeve 12, it being understood that a soldered connection can be made in place of, or in addition to, the crimped connection.

The connector 10 can be used in a conventional manner by placing it around a threaded shank, or post, 20 associated with a bolt-like member of a barrier strip, a screw strip, or a terminal block of an electrical circuit or an electrical component, with the legs 14 and 16 flanking the post. The head portion of the threaded post 20 can then be tightened over the connector 10 to secure the connector and thus complete the electrical connection between the conductor in the sleeve 12 and a similar conductor, or circuit, (not shown) connected to the post. The bent portions 16*a* and 18*a* are provided for aiding in securing or stabilizing the connection and can engage raised portions, or the like, of the terminal to prevent rotation or angular movement of the spade lug 10 relative to the terminal.

The connector 10 of the present invention also can be used with a terminal (not shown) of the type having a spring-loaded member which is pushed to expose an opening for receiving a conductor or pin. In this case the extension 18 is simply inserted into the above-mentioned opening and the spring-loaded member is released to secure the connection. The leg 16 does not interfere with this connection since it extends at an angle to the extension 18 and is shorter in length than the combined lengths of the leg 14 and the extension 18.

It is thus seen that several advantages result from the foregoing. For example, the connector 10 of the present invention provides an electrical connection between a conductor and one of several different types of terminals in a simple, quick and efficient manner. Also, the connector of the present invention can be utilized with the most popular type of terminal connections without the necessity of replacing the spade lug with another type connector. Further, the connector of the present invention can be used in the above manners without introducing any moments of inertia.

It is understood that variations may be made in the foregoing without departing from the scope of the invention. For example, the base portion of the connector of the present invention is not limited to a sleeve as shown, but can be in the form of any other type of base portion suitable for electrical connection to a conductor.

Other modifications, changes and substitutions are intended in the foregoing disclosure and, in some instances, some features of the invention can be employed without a corresponding use of other features. Accordingly, it is appropriate that the appended claims be construed broadly and in a manner consistent with the scope of the invention.

What is claimed is:

1. An electrical connector comprising a member for receiving an electrical conductor, two parallel legs formed integrally with, and extending from, said member and spaced apart a distance sufficient to accommodate a post of an electrical terminal, each of said parallel legs extending at an angle to the axis of said member, and an extension formed on one of said legs for extending within an opening in another electrical terminal, said extension extending at an angle to said one leg, and the longitudinal axis of said extension coinciding with an extension of an axis of said member.

2. The connector of claim 1 wherein said extension and the other leg each includes a straight portion and a free end portion bent so as to extend substantially perpendicularly to said straight portion to facilitate connection to said terminal.

3. The connector of claim 1 wherein the combined lengths of said extension and said one leg is greater than the length of the other leg.

4. The connector of claim 1 wherein said two legs are adapted to extend around a binding post forming a part of an electrical terminal and wherein said extension is adapted to extend within an opening defined by a different terminal.

5. The connector of claim 1 wherein said member comprises a sleeve for receiving said conductor, and adapted to be crimped around said conductor.

* * * * *